US006095133A

United States Patent [19]

Walters

[11] Patent Number: 6,095,133

[45] Date of Patent: Aug. 1, 2000

[54] GAS TUBE ASSEMBLY

[75] Inventor: Jon Scott Walters, St. Louis County, Mo.

[73] Assignee: American General Products, Inc., Maryland Heights, Mo.

[21] Appl. No.: 09/373,528

[22] Filed: Aug. 12, 1999

Related U.S. Application Data

[60] Provisional application No. 60/096,511, Aug. 16, 1998.

[51] Int. Cl.[7] ..... F24C 3/04

[52] U.S. Cl. ..... 126/41 R; 126/39 R; 431/354; 431/355

[58] Field of Search ..... 126/41 R, 39 R, 126/39 E; 431/353, 354; 138/121, 122; 285/903, 169, 226; 48/180.1

[56] References Cited

U.S. PATENT DOCUMENTS

| | | | |
|---|---|---|---|
| Re. 32,133 | 5/1986 | Koziol . | |
| D. 326,031 | 5/1992 | Walters et al. . | |
| D. 407,811 | 4/1999 | Walters . | |
| 741,991 | 10/1903 | Adams . | |
| 905,009 | 11/1908 | Shores . | |
| 1,572,833 | 2/1926 | Baker . | |
| 1,827,505 | 10/1931 | Bluhm . | |
| 3,090,372 | 5/1963 | Evans . | |
| 3,332,339 | 7/1967 | Helgeson et al. . | |
| 3,472,131 | 10/1969 | Perusse et al. . | |
| 3,472,132 | 10/1969 | Perusse et al. . | |
| 3,626,923 | 12/1971 | Martin . | |
| 3,638,635 | 2/1972 | Drennan . | |
| 3,938,494 | 2/1976 | Clark . | |
| 4,092,975 | 6/1978 | Grammatopoulos . | |
| 4,149,516 | 4/1979 | Hall . | |
| 4,267,816 | 5/1981 | Koziol . | |
| 4,314,717 | 2/1982 | Bjurman | 138/121 |
| 4,373,505 | 2/1983 | Koziol . | |
| 4,462,384 | 7/1984 | Hitch . | |
| 4,478,205 | 10/1984 | Koziol . | |
| 4,485,799 | 12/1984 | Perez . | |
| 4,488,534 | 12/1984 | Koziol . | |
| 4,586,483 | 5/1986 | Perez . | |
| 4,598,692 | 7/1986 | Hitch . | |
| 4,624,240 | 11/1986 | Hitch . | |
| 4,679,544 | 7/1987 | Koziol . | |
| 4,686,957 | 8/1987 | Koziol . | |
| 4,773,384 | 9/1988 | Koziol . | |
| 4,827,899 | 5/1989 | Walters et al. . | |
| 4,836,180 | 6/1989 | Walters et al. . | |
| 4,909,547 | 3/1990 | Guy | 285/903 |

FOREIGN PATENT DOCUMENTS

| | | |
|---|---|---|
| 28295 | 2/1884 | Germany . |
| 2524492 | 12/1976 | Germany . |
| 1325436 | 8/1973 | United Kingdom . |

*Primary Examiner*—James C. Yeung
*Attorney, Agent, or Firm*—Paul M. Denk

[57] ABSTRACT

A gas-air flexible tubing assembly for use for interconnecting a supply of gas, such as bottled gas, to the burner of a cooking grill, the flexible tubing formed of helical coiled wire, and coated with a flexible and expandable polymer, interconnects with, at one end, and air-gas intake tube, by means of a threaded connection, and connects, at its opposite end, by means of a threaded connection with the downward extension of an adapter, for securement of the assembly to the underface of the burner element of a gas grill.

1 Claim, 2 Drawing Sheets

GAS TUBE ASSEMBLY

CROSS REFERENCE TO RELATED APPLICATIONS

This application claims benefit of provisional application No. 60/096,511, filed Aug. 16, 1998.

BACKGROUND OF THE INVENTION

This invention relates generally to a gas tube assembly, and more specifically to an assembly of an air intake duct, in addition to an adapter, with an expandable type of flexible tubing arranged therebetween, to provide for transmission of the gas from its reservoir, or bottle, and to the burner of a gas barbecue grill unit, in order to furnish heat for cooking of food products, and the like.

There are a variety of adapter means that have been developed for use in conjunction with gas fired cooking grills, and which facilitate the installation, usage, and transmission of gas to the grill, during installation and usage of a bar-b-que grill. For example, the prior United States patent to the inventor herein, U.S. Pat. No. 4,827,899, discloses an adjustable gas tube assembly. In this disclosure, it can be seen that a type of gas transmission tube, and which further includes air regulator means, is attached to one end of the shown tubing, while at the other end a mounting bracket or adapter is also disclosed, and for use for securement of the gas transmission tubing directly to the underside intake portion of the burner for the grill, as known in the art. But, as can be seen from this earlier embodiment, it necessitated the use of clamps, at both ends of the flexible tubing, for use for securement of both the tubular air regulator member, and the extension of the mounting bracket adapter, during the installation and usage of the shown assembly.

Another previous United States patent to the inventor herein, U.S. Pat. No. 4,836,180, shows an adapter device for application of its shown gas line source, to the underside or lower face of the shown burner element, during attachment of this gas transmission means directly to the burner assembly.

A further embodiment relating to the current invention is the adjustable gas tube design as shown in the inventor's earlier U.S. Pat. No. Des. 326,031, and as can be seen, a similar type of flexible tubing is attached to both its adapter, and its air intake and gas transmission tube, at opposite ends of the said flexible line. But, in the assembly of that earlier embodiment, it necessitated the use of crimping means, to accomplish attachment of the flexible tubing to both the air line, and the adapter, and this particular step, of assembly, is both cumbersome, and costly, to achieve.

Other prior United States patents show related embodiments, for the structure and assembly of various types of gas flow or transmission lines, when used in conjunction with a cooking grill, or the like.

Other prior United States patents relate to the subject matter of this invention. For example, the patent to Koziol, U.S. Pat. No. 4,488,534, discloses a dual adjustable gas intake assembly. This particular device shows how crimping, or integral formation, connects a flexible, but not extendable supply tube to its regulator and intake section.

Another patent to Koziol, U.S. Pat. No. Re. 32,133, shows another adjustable venturi tube assembly for a gas barbecue grill. This patent discloses a fixed type of intake assembly.

Another patent to Koziol, U.S. Pat. No. 4,773,384, shows a very related style of adjustable gas intake assembly, to that as just previously described.

The United States patent to Hitch, U.S. Pat. No. 4,624,240, shows a universal gas burner with dual adjustable flexible venturi tube assembly for gas-fired barbecue grills.

Another patent to Koziol, U.S. Pat. No. 4,373,505, shows an adjustable venturi tube assembly for a gas barbecue grill.

Yet another United States patent to Koziol, U.S. Pat. No. 4,679,544, shows a threaded adjustable gas intake assembly. But, as can be seen from this prior art patent, it is the flexible tube itself that threads within a larger section of the flexible tube, and does not present a threaded engagement between any intake tube, or an adapter, that connects to the ends of the flexible tube per se.

Another patent to Koziol, U.S. Pat. No. 4,478,205, shows a dual adjustable gas intake assembly.

A further patent to Hitch, U.S. Pat. No. 4,598,692, shows a universal gas burner and dual adjustable flexible venturi tube arrangement for gas barbecue grills.

A further patent to Hitch, U.S. Pat. No. 4,462,384, shows a universal adjustable replacement gas burner.

A further patent to Koziol, U.S. Pat. No. 4,267,816, discloses a universal burner element for a gas barbecue grill.

The patent to Martin, U.S. Pat. No. 3,626,923, discloses what is identified as a gas burner, and shows an intake valve at its bottom.

The patent to Clark, U.S. Pat. No. 3,938,494, shows another form of cooking apparatus.

The patent to Perez, U.S. Pat. No. 4,586,483, discloses an adjustable dual venturi assembly.

Another patent to Perez, U.S. Pat. No. 4,485,799, shows a dual burner gas grill alignment device.

The patent to Drennan, U.S. Pat. No. 3,638,635, shows a split gas burner.

The patent to Grammatopoulos, U.S. Pat. No. 4,092,975, shows a plural chamber sheet metal gas burner and method of manufacture.

The patent to Hall, U.S. Pat. No. 4,149,516, shows a barbecue grill with a gas burner intake at its bottom.

The patent to Helgeson, U.S. Pat. No. 3,332,339, shows a portable outdoor broiler and cooker.

The patent to Evans, U.S. Pat. No. 3,090,372, shows a barbecue attachment.

The patent to Bluhm, U.S. Pat. No. 1,827,505, shows a gas burner with a flexible gas line.

The patent to Shores, U.S. Pat. No. 905,009, shows a brazier's lamp.

The patent to Adams, U.S. Pat. No. 741,991, discloses a lighting attachment for gas stoves.

Another patent to Koziol, U.S. Pat. No. 4,686,957, shows a gas nozzle attachment.

The patent to Baker, U.S. Pat. No. 1,572,833, discloses a burner construction.

There are select foreign patents relating to this technology. German patent No. 2524492, shows a cooking unit with gas fired hob unit, which includes burners connected to gas control devices by movable type gas pipes.

The German patent No. 28295 shows a form of gas burner.

Finally, British patent No. 1325436 shows improvements relating to gas mixing tubes.

SUMMARY OF THE INVENTION

The principal object of the current invention is to provide inherent means, formed into the structure of the various components for a gas transmission line, for use with a cooking grill, that allows immediate installation of the various gas line and adapter directly to opposite ends of the expandable and flexible tubing, used in conjunction therewith, by either the installer, or the purchaser, in preparation for use of a gas fired grill.

This invention contemplates the formation of a gas line assembly, wherein a flexible tubing is utilized during installation of the gas supply line directly to its burner, and wherein the flexible gas line is both expandable, and capable of being bent or turned, into various configurations, to conveniently allow for its installation for the delivery of gas directly to the burner assembly, in preparation for usage of the cooking grill. The flexible line of this invention is known in the art, and is generally identified as a helically ribbed copper tubing, which is both flexible and expandable so as to permit universal adjustment in the gas tube assembly during mounting to the gas barbecue unit. The copper tubing, or even aluminum tubing, or other flexible type of wire used in the fabrication of this type of flexible means, allows for its expansion, between the helical coils, as the tubing is expanded to provide for installation of both the gas intake tube into a transmission connection with the supply of bottled gas, at one end, and at the same time, the same tubing can be expanded and lengthened, in addition to turned, at its opposite end, to allow for its adapter to be secured to the underside or lower face of the burner assembly, during installation. Examples of these helical ribbed copper tubing constructions can be seen in the prior U.S. Pat. Nos. 3,472,131, and 3,472,132. Tubes of this type have an elongated helical coil, which may be formed of various types of metal, polymer, or the like, over which there is molded a thick-walled polymeric tubing. The polymeric tubing is highly flexible, expandable, and can be manipulated into various angular positions, to allow for ready adjustment to locate its end structural components, namely, the gas-air intake tube, and the adapter, at the other end, into their respective positions when the gas supply is installed into its connection with the burner assembly.

The means for interconnection between the flexible tubing, as explained above, and the air-gas intake tube, in addition to the securement of the adapter, to the opposite end of the flexible tubing, is a threaded engagement. During the formation of the helically ribbed tubing, forming the flexible gas line herein, the strand of wire forming the support for the tubing is helically wound, as can be understood, and as seen in the prior art, and which provides a form of internal thread-like surface, within the tubing, throughout its extent, and particularly at its ends, and has been found to be readily receptive for securement with the external threads of another component. For example, at the downstream end of the gas-air intake tube there is provided a short length of sleeve, and this sleeve is formed having external threads provided thereon. Actually, the sleeve may be just an extension of the intake tube, or it may be of a slightly reduced diameter, but yet integrally formed or secured therewith, during its formation. These external threads formed thereon are designed for threadedly engaging within the proximate end of the flexible helical tube, and does provide, when turned therein, a secure and tight engagement between the flexible tubing, and the air intake tube, once assembled.

In addition, the adapter provided at the opposite end of the flexible tubing, likewise has a downwardly positioned tubular extension, which also contains a series of external threads provided thereon, and which are designed for mating within and threadedly engaging within the opposite end of the flexible tubing, to provide for a secure engagement between said adapter, and the tubing, once assembled. Once that is done, the flexible helical tubing can be expanded, and manipulated, in order to allow for the adapter to be secured, as aforesaid, to the underface of the burner assembly, and likewise, the air-gas intake tube can be pressure fitted onto the gas port, of the bottled gas, or other gas supply line, during installation.

It is just as likely that the various threaded connections with the flexible tubing can be arranged for an external connection, whereby the tubular extension of the adapter can thread onto the outside of the adjacent flexible tubing, and likewise, the sleeve of the gas intake tube can be threadedly engaged onto the exterior of the approximate opposite end of the flexible tubing, during installation. These are just examples of variations for a threaded interconnection between these various components, and the flexible tubing, during installation. Nevertheless, as can be readily understood, the essence of the invention is to eliminate the need for crimping, clamps, and other forms of connection, previously used, during the assembly and application of the gas intake line of this invention.

Hence, another primary object of this invention is to provide a fully interconnectable gas line assembly, that can be immediately connected together on sight, during its installation into a gas cooking grill.

A further object of this invention is to provide means to eliminate the need for crimping, clamping, or other means of interconnection, between the components forming the gas line of a gas cooking grill, during its assembly.

A further object of this invention is provide means for readily threaded engagement between various adapters, gas tubes, and a flexible tubing, while connecting a gas supply to the burner of a gas cooking grill.

Another object of this invention is to provide means for substantially reducing the cost of manufacture, assembly, and installation of a gas supply line, for a gas cooking grill.

Another purpose of this invention is to provide a very tight and leak-proof connection between the flexible tubing of a gas supply line, and its various accessories that connect it to the gas supply, and the burner assembly, during installation.

These and other objects may become more apparent to those skilled in the art upon reviewing the summary of the invention as provided herein, and upon undertaking a study of the description of its preferred embodiment, in view of the illustrative drawings.

DESCRIPTION OF THE PREFERRED EMBODIMENT

Figure 1:
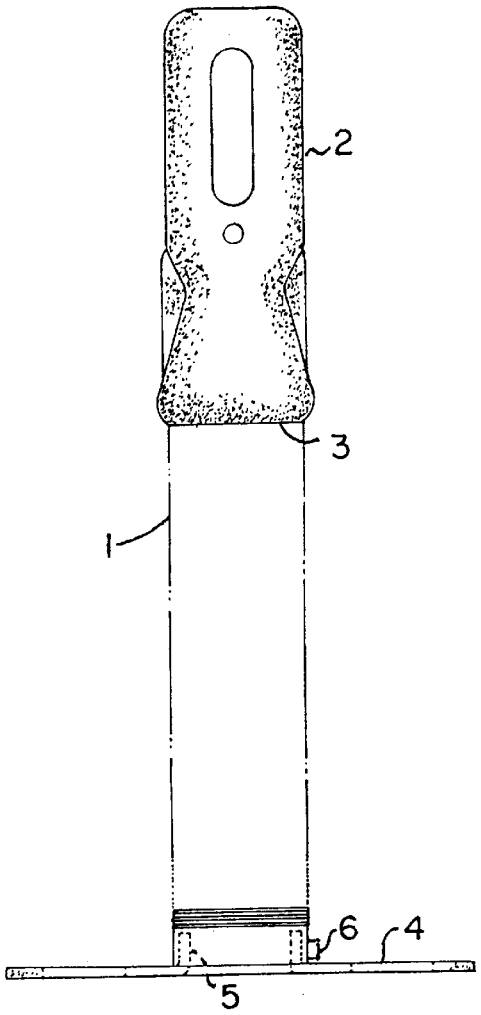
FIG. 1 PRIOR ART
FIG. 1 provides a view of a prior art type of adjustable gas tube assembly.

In referring to the drawings, and in particular FIG. 1, the prior art style of adjustable gas tube assembly is shown. As disclosed therein, the flexible type tube as previously explained, disclosed at 1, is secured to its gas intake tube 2 by means of a crimping connection, as at the vicinity of 3. In addition, where the flexible tubing 1 connects with its adapter 4, it may be slid over the tubular extension 5 of the adapter, and then secured in place by means of a clamp, as at 6, to provide for securement thereat. Or, another form of crimping action, may have been employed in the prior art, to furnish an interconnection between such flexible tubing, and its adapter, at the situs of its manufacture.

Figure 2:
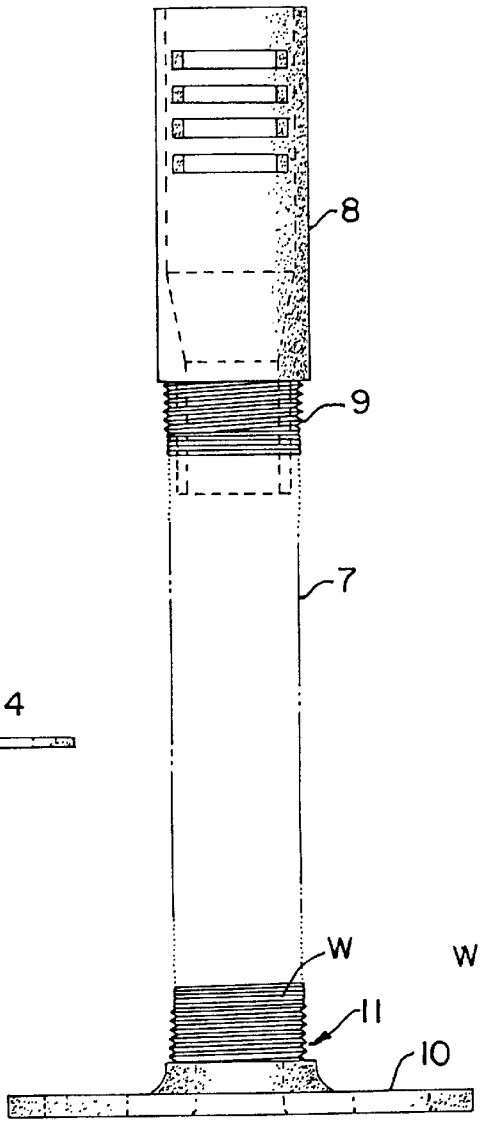
FIG. 2 is a top view of the gas tube assembly of this invention.
Figure 3:
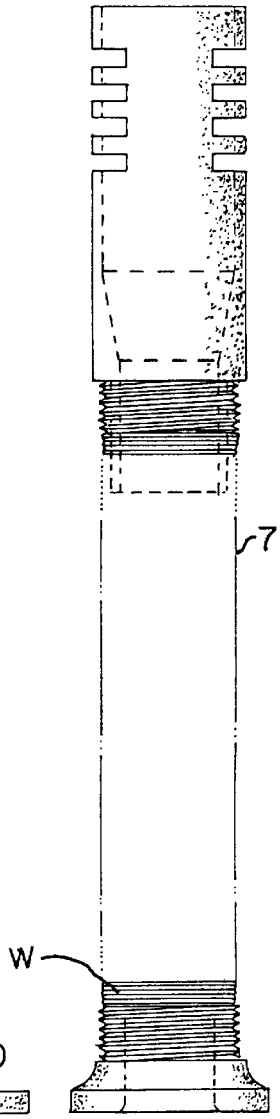
FIG. 3 is a side view of the gas tube assembly of this invention.
Figure 4:
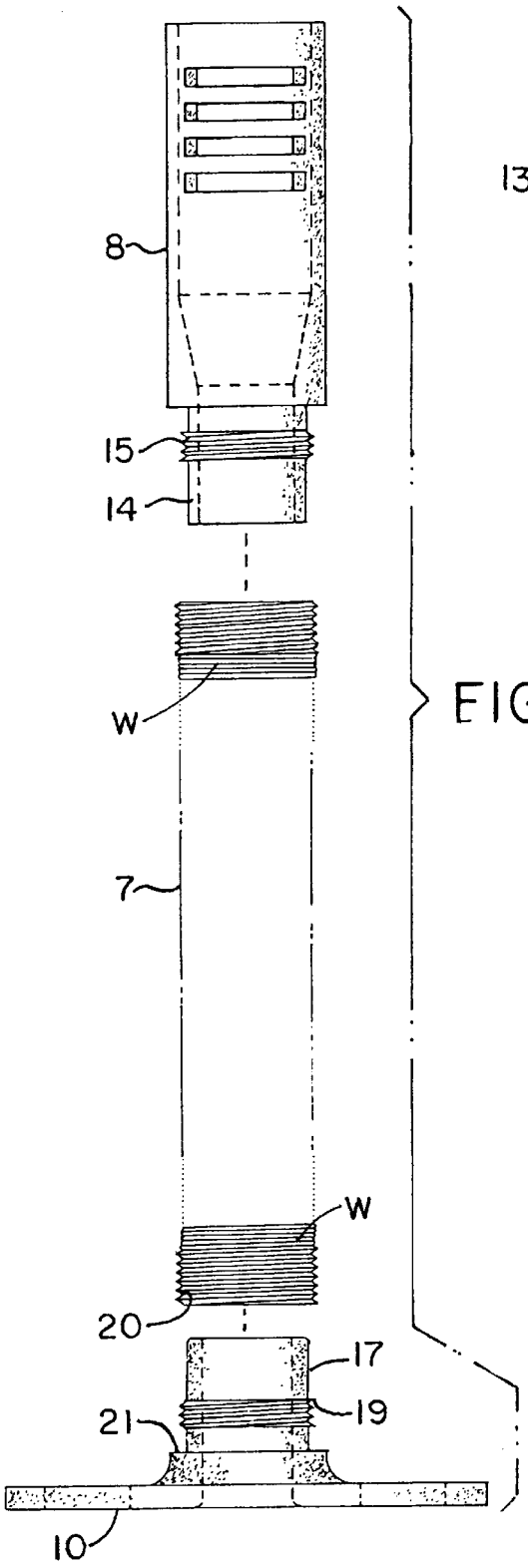
FIG. 4 is a top exploded view of the gas tube assembly of this invention.
Figure 5:
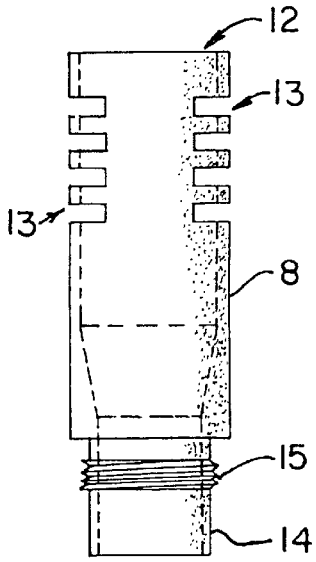
FIG. 5 is a top view of the air-gas intake tube of this invention.
Figure 6:
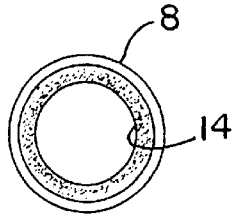
FIG. 6 is a rear view thereof.
Figure 7:
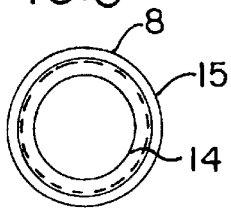
FIG. 7 is a front view thereof.

The style of adjustable gas tube assembly of this invention, is shown in FIGS. 2 through 4. As can be seen, the flexible tubing 7 of the type as previously described, interconnects with its air-gas intake tube 8 through a threaded engagement, as at 9, while the opposite end of the flexible tubing 7 connects with its adapter 10 once again, through a threaded engagement as at 11, as noted. The threaded areas can be independently formed at the ends of the flexible tubing. Preferably, however, during the formation of the helically ribbed tubing, forming the flexible gas line herein, the strand of wire W forming the support for the tubing is helically wound to provide a form of internal thread-like surface, within the tubing, throughout its extent, and particularly at its ends, and has been found to be readily receptive for securement with the external threads of another component. The support wire can be configured externally so that the threaded areas of flexible tubing are designed for an external connection, whereby components can thread onto the outside of the adjacent flexible tubing, The air-gas intake tube 8 is more aptly disclosed in FIG. 5, in addition to FIG. 4, and includes a length of tubular member, having a flow path, as at 12, therethrough, and has a series of slits, as at 13, as can be noted. Gas flows through the interior passage 12, on its conveyance towards the gas burner (not shown), while a regulated amount of air enters through the passages 13, to provide the proper gas-air mix, required to furnish the desired flame above the burner, during usage of the gas fired barbecue grill. But, as can be seen at the approximate front end of the air-gas tube, there is an extension in the form of a sleeve 14, which may be of a reduced diameter, or perhaps to the same diameter as the tube 8, as previously explained. In addition, this extended sleeve 14 may be integral, or connected thereto by other means. But, as can be seen, the sleeve incorporates a series of external threads, as at 15, and it is these threads that are designed for threadedly mating interiorly of the proximate end of the flexible tubing 7, as can be seen in FIG. 4. Likewise the sleeve of the gas intake tube can be threadedly engaged onto the exterior of the approximate opposite end of the flexible tubing, during installation. The threaded relationship between these two components, namely, the threads 15, of the tube 8, and the helical wound wire configuration for the flexible tubing 7, are such as to provide for a threaded engagement therein, during assembly. All that needs to be accomplished is for the tube 8 to be turned, and threadedly engage within the approximate end of the flexible tubing 7, to achieve a secure retention. And, as previously explained, it is just as likely that the threads 15 may be internal threads, within a larger sleeve 14, and provide for its threaded engagement upon the exterior of the approximate end of the flexible tube 7, for installation.

Figure 8:
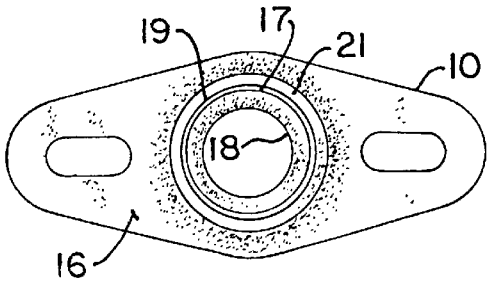
FIG. 8 is a bottom view of the adapter as shown in FIG. 4.
Figure 9:
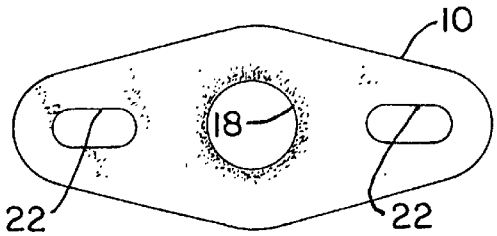
FIG. 9 is a top view thereof.

The means for connection of the adapter 10 to the flexible tube 7 can also be determined from viewing this component as shown in FIGS. 4, 8 and 9. As can be seen, the adapter has a peripheral and laterally extending flange-like portion 16, and has a downwardly extension 17 either integrally formed or connected centrally thereof. There is an opening 18 provided centrally through the adapter, as can be noted. There is provided around the exterior perimeter of the extension 17 a series of threads 19, which are designed for threadedly engaging within the helical coiled thread-like arrangement 20 formed at the proximate end of the flexible tubing 7, as can be noted. Thus, when the adapter, and its extension 17, is threaded within the approximate end of the flexible tubing, it engages upon and extends up to the formed shoulder 21 of the adapter, when fully assembled. Thus, there is no need for any crimping action, or the use of any external clamp, and the adapter may be simply threadedly engaged within the approximate end of the flexible tubing 7, for immediate assembly.

Obviously, the arrangement of the threads 15 upon the sleeve 14, and likewise the orientation of the threads 19, upon the extension 17, will be such as to complement and cooperate with the helical coil arrangement of the flexible tubing 7, so as to provide for a threaded engagement therein, when either the tube 8, or the extension 17, are located within and turned for threaded engagement with the interior of the flexible tubing 7. Obviously, the threads will either be right hand threads, or left hand threads, in order to provide for a complemental threaded engagement within the tubing 7, depending upon the configuration and slope of the helical coil forming the flexible tubing 7, as previously described. Likewise, the size of the threads will be complemental with respect to the size of the helical coil forming the flexible tubing 7, so as to provide for a threaded engagement between these various components, when interconnected together. Likewise, as previously explained, it is just as possible that the sleeve 14, or the extension 17, may have internal threads, and be of slightly larger size, so as to allow for their threaded engagement upon the exterior of the ends of the flexible tubing 7, should that type of connection be required.

In addition, as can be seen, the adapter 10 may have a series of slots 22, through which screws or bolts may insert, when applying the adapter to the undersurface of the burner (not shown), when the gas tube assembly of this invention is installed.

Variations or modifications to the subject matter of this invention may be envisioned by those skilled in the art upon reviewing the disclosure as provided herein. Such variations or modifications, are intended to be encompassed by the scope of this invention, as defined. It is the principal of the invention that is sought for protection, whereas, the description of the preferred embodiment, and the drawings, are set forth merely for illustrative purposes only.

What is claimed is:

1. A gas tube assembly comprising:

a gas delivery tube formed of helically ribbed material, the internal surface thereof defining an internal bore, said helically ribbed material being both flexible and expandable, said delivery tube having a helically wound support provided therein, and upon which the helically ribbed material is provided thereon;

said gas delivery tube having a first open end and a second open end, said first open end having a first internally threaded surface, and said second open end having a second internally threaded surface;

an air-gas intake tube threadedly engaged within said gas delivery tube at one of said first or second open ends;

an adapter threadedly engaged to said gas delivery tube at the opposite of said first or second open ends, said adapter including an extension, said extension having laterally extending flange-like portions extending from either side of said extension, said extension being externally threaded, and said extension providing the threaded engagement of the adapter within said gas delivery tube at its proximate end.

* * * * *